US012007203B1

(12) United States Patent
Archer et al.

(10) Patent No.: US 12,007,203 B1
(45) Date of Patent: Jun. 11, 2024

(54) WEAPON CONTROL SYSTEM WITH INTEGRATED MANUAL AND ASSISTED TARGETING

(71) Applicant: Flex Force Enterprises Inc., Portland, OR (US)

(72) Inventors: Cynthia Louise Archer, Sherwood, OR (US); Jacob Ryan Sullivan, Hood River, OR (US); John Holbrook Vance, II, Oakland, CA (US)

(73) Assignee: Flex Force Enterprises Inc., Portland, OR (US)

( * ) Notice: Subject to any disclaimer, the term of this patent is extended or adjusted under 35 U.S.C. 154(b) by 94 days.

(21) Appl. No.: 17/706,175

(22) Filed: Mar. 28, 2022

(51) Int. Cl.

| | |
|---|---|
| ***F41G 5/06*** | (2006.01) |
| ***F41G 3/06*** | (2006.01) |
| ***F41G 3/22*** | (2006.01) |
| *F41G 5/14* | (2006.01) |

(52) U.S. Cl.
CPC ..... *F41G 5/06* (2013.01); *F41G 3/065* (2013.01); *F41G 3/22* (2013.01); *F41G 5/14* (2013.01)

(58) Field of Classification Search
CPC ... F41G 3/065; F41G 3/22; F41G 5/06; F41G 5/14
USPC ..... 89/28.1
See application file for complete search history.

(56) References Cited

U.S. PATENT DOCUMENTS

| | | | | |
|---|---|---|---|---|
| 5,347,910 | A * | 9/1994 | Avila | F41G 3/22 89/41.22 |
| 9,074,847 | B1 * | 7/2015 | Sullivan | F41G 5/16 |
| 10,890,407 | B1 * | 1/2021 | Archer | F41G 5/14 |
| 2021/0140733 | A1 * | 5/2021 | Herskowitz | F41A 17/08 |
| 2021/0389093 | A1 * | 12/2021 | Bilbrey | F41G 3/142 |
| 2022/0205762 | A1 * | 6/2022 | Ehrlich | F41G 3/02 |

* cited by examiner

*Primary Examiner* — Joshua E Freeman
*Assistant Examiner* — Benjamin S Gomberg
(74) *Attorney, Agent, or Firm* — The Law Office of Raul D. Martinez, PC

(57) ABSTRACT

The devices, systems, and methods described herein are directed to a manual and assisted targeting system integrated into a weapon control system that includes dual triggers. One trigger is fully manual and is always operational. The second trigger is electronically controlled and is linked to aiming sensors, targeting sensors, and a controller comprising firing control logic. The firing control logic calculates an aim goal, based at least partially on location information pertaining to the target, and determines when the difference between the aimpoint of the weapon and the aim goal is below a threshold. In response to this determination, a control signal is sent to a trigger actuator to fire the weapon.

22 Claims, 4 Drawing Sheets

WEAPON CONTROL SYSTEM WITH INTEGRATED MANUAL AND ASSISTED TARGETING

FIELD

The subject matter described herein relates to weapon control systems and more particularly to weapon control systems with integrated targeting systems.

BACKGROUND

A weapon platform is generally any structure or system on which a weapon can be mounted. For example, a fighter jet is a weapon platform for missiles, bombs, or autocannons. Other vehicles, such as the Humvee, are considered weapon platforms as well, such as for grenade launchers, machine guns, and some missile launchers. Thus, the term "weapon platform" can describe an aircraft, a vehicle, a naval vessel, or an actual firearm system. In more general use, a weapon platform could be structured around a gun, such as a gun turret on a ship, or bracing on an aircraft.

SUMMARY

The devices, systems, and methods described herein are directed to a manual and assisted targeting system integrated into a weapon control system that includes dual triggers. One trigger is fully manual and is always operational. The second trigger is electronically controlled and is linked to aiming sensors, targeting sensors, and a controller comprising firing control logic. The firing control logic calculates an aim goal, based at least partially on location information pertaining to the target, and determines when the difference between the aimpoint of the weapon and the aim goal is below a threshold. In response to this determination, a control signal is sent to a trigger actuator to fire the weapon.

In one example, a weapon platform comprises a cradle having a shape and size to receive and secure a weapon. The weapon platform also comprises a manual trigger to, upon actuation by an operator, fire the weapon mounted in the cradle. The weapon platform further comprises at least one aiming sensor to obtain aimpoint information pertaining to the weapon mounted in the cradle. The weapon platform additionally comprises at least one targeting sensor to track a location of a target relative to the weapon platform. The weapon platform further comprises a controller comprising firing control logic and an electronic trigger to, upon actuation by the operator, activate the firing control logic within the controller. The controller determines an aimpoint of the weapon mounted in the cradle, based at least partially on a signal, received from the at least one aiming sensor, containing the aimpoint information; calculates an aim goal, based at least partially on a signal, received from the at least one targeting sensor, containing location information pertaining to the target; determines whether a difference between the aimpoint of the weapon mounted in the cradle and the aim goal is below a threshold; and in response to a determination that the difference between the aimpoint of the weapon mounted in the cradle and the aim goal is below the threshold, transmits a control signal to fire the weapon mounted in the cradle. The weapon platform also comprises a trigger actuator to selectively fire the weapon mounted in the cradle, based at least partially on the control signal from the controller.

In some examples, actuation of the electronic trigger does not inhibit firing the weapon with the manual trigger.

In some examples, the at least one targeting sensor comprises a passive targeting sensor. In some examples, the passive targeting sensor comprises an electro-optical sensor.

In some examples, the at least one targeting sensor comprises an active targeting sensor. In some examples, the active targeting sensor comprises a radar. In some examples, the active targeting sensor comprises a laser.

In some examples, the at least one targeting sensor comprises one or more sensors to determine a geographical location and an orientation of the weapon platform.

In some examples, the at least one targeting sensor comprises a sensor to detect a target designator. In some examples, the target designator comprises a laser emitted from a laser pointer.

In some examples, the at least one targeting sensor receives a target designation input from the operator.

In some examples, the at least one targeting sensor automatically detects the target.

In another example, a system comprises a weapon and a weapon platform. The weapon platform comprises a cradle having a shape and size to receive and secure the weapon. The weapon platform also comprises a manual trigger to, upon actuation by an operator, fire the weapon mounted in the cradle. The weapon platform further comprises at least one aiming sensor to obtain aimpoint information pertaining to the weapon mounted in the cradle. The weapon platform additionally comprises at least one targeting sensor to track a location of a target relative to the weapon platform. The at least one targeting sensor comprises at least one of the following: an electro-optical sensor, a radar, a laser, one or more sensors to determine a geographical location and an orientation of the weapon platform, and a sensor to detect a target designator. The weapon platform also comprises a controller comprising firing control logic and an electronic trigger to, upon actuation by the operator, activate the firing control logic within the controller. Actuation of the electronic trigger does not inhibit firing the weapon with the manual trigger. The controller determines an aimpoint of the weapon mounted in the cradle, based at least partially on a signal, received from the at least one aiming sensor, containing the aimpoint information; calculates an aim goal, based at least partially on a signal, received from the at least one targeting sensor, containing location information pertaining to the target; determines whether a difference between the aimpoint of the weapon mounted in the cradle and the aim goal is below a threshold, and in response to a determination that the difference between the aimpoint of the weapon mounted in the cradle and the aim goal is below the threshold, transmits a control signal to fire the weapon mounted in the cradle. The weapon platform further comprises a trigger actuator to selectively fire the weapon mounted in the cradle, based at least partially on the control signal from the controller.

In some examples, the at least one targeting sensor receives a target designation input from the operator.

In some examples, the at least one targeting sensor automatically detects the target.

In a further example, a method comprises actuating an electronic trigger of a weapon platform on which a weapon is mounted. The weapon platform comprising a cradle having a shape and size configured to receive and secure the weapon. The weapon platform also comprising a manual trigger to, upon actuation by an operator, fire the weapon mounted in the cradle. The weapon platform additionally comprising at least one aiming sensor to obtain aimpoint information pertaining to the weapon mounted in the cradle. The weapon platform further comprising at least one targeting sensor to track a location of a target relative to the weapon platform. The weapon platform also comprising a controller comprising firing control logic. The electronic trigger, upon actuation by the operator, activates the firing control logic within the controller. The controller determines an aimpoint of the weapon mounted in the cradle, based at least partially on a signal, received from the at least one aiming sensor, containing the aimpoint information; calculates an aim goal, based at least partially on a signal, received from the at least one targeting sensor, containing location information pertaining to the target; determines whether a difference between the aimpoint of the weapon mounted in the cradle and the aim goal is below a threshold; and in response to a determination that the difference between the aimpoint of the weapon mounted in the cradle and the aim goal is below the threshold, transmits a control signal to fire the weapon mounted in the cradle. The weapon platform further comprises a trigger actuator to selectively fire the weapon mounted in the cradle, based at least partially on the control signal from the controller. The method also comprises, prior to the trigger actuator firing the weapon, actuating the manual trigger to fire the weapon mounted on the weapon platform.

In some examples, the method further comprises receiving a target designation input from the operator.

In some examples, the method further comprises automatically detecting the target.

DETAILED DESCRIPTION

Figure 1A:
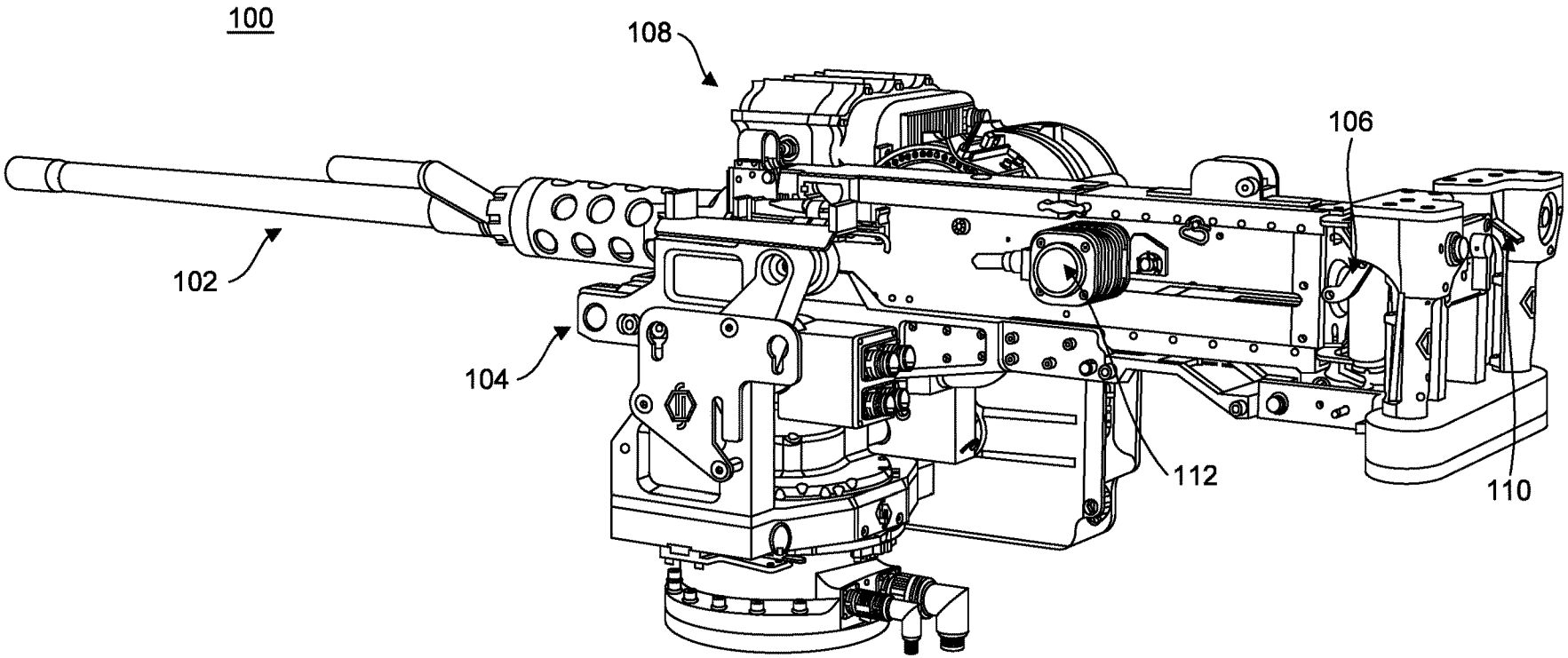
FIG. 1A is a perspective-view schematic illustration of an example weapon and weapon platform having a manual trigger and an electronic trigger.

Light and medium class weapons are typically fired from weapon mounts that are themselves attached to a platform. Examples of light class weapons include the M240 machine gun, the M2HB .50 caliber machine gun, and the MK19 40 mm automatic grenade launcher. Examples of medium class weapons include a variety of 40×53 mm automatic grenade launchers, 25 mm chain guns, and 30×173 mm rapid-fire cannons.

Examples of weapon mounts include crew-served weapon mounts such as rotorcraft door gunners and maritime weapon mounts, crew-served tripod mounts commonly used by dismounted soldiers, and a wide variety of fixed, flexible, and other moveable vehicle weapon mounts. Examples of platforms include riverine craft such as the Combatant Craft Medium (CCM) and the Special Operations Craft—Riverine (SOC—R), surface warfare craft such as the Littoral Combat Ship (LCS), infantry fighting vehicles such as the M2 Bradley, multipurpose vehicles such as the High Mobility Multipurpose Wheeled Vehicle (HMMWV), main battle tanks such as the M1A2 Abrams, and rotorcraft such as the UH-1 Huey and UH-60 Blackhawk.

When small and medium caliber weapons are fired from ground emplaced bipods or tripods, they are very effective and provide an acceptable probability of hit when operated by a qualified warfighter against a static target. In a sniper accuracy report, Army Research Laboratories (ARL) noted that a trained sniper using a M24 rifle system with laser range finder and mounted on a tripod had a probability of hit against man sized targets (0.50 m×0.86 m) at 500 m of 53% and at 1000 m of 3%. Thus, hitting a target with a ballistic weapon at long ranges (e.g., over 500 m) is difficult even with a calibrated weapon and an experienced gunner.

As used herein, the terms "sniper," "gunner," "operator," and "user" are used interchangeably. Likewise, the terms "firing assistance" and "targeting assistance" are also used interchangeably herein. The terms "weapon platform" and "weapon mount" are also used interchangeably. The term "firing on incidence" is used to refer to the concept in which the weapon is fired when a calculation determines, within a desired level of confidence (e.g., a threshold level), that the aimpoint of the weapon is incident upon a desired aim goal. As used herein, the term "mechanical trigger" generally refers to a lever, button, or switch that the operator actuates to fire the weapon mounted in the cradle of the weapon platform. The term "electrical trigger" generally refers to a lever, button, or switch that, upon actuation by an operator, activates firing control logic within the controller of the weapon platform.

Environmental and ballistic factors significantly deflect a bullet at longer ranges over its flight time, which reduces a sniper's ability to place rounds on target. The most significant of these factors is gravity. Gravity pulls the bullet toward the earth over its flight time so that the bullet traces a parabolic arc, ending lower than the point at which it left the weapon. A trained gunner or sniper compensates for this ballistic effect by aiming above the target, raising the aim further for a more distant target to adjust for the longer time that gravity acts on the bullet. Aiming a weapon up or down hill at a target is significantly more difficult than a similar flat shot due to changes in flight time that are difficult to estimate.

The effects of gravity are exacerbated by atmospheric drag on the bullet. This drag is a function of the type of round fired. Thus, the drag varies not only with weapon caliber but also with bullet shape and other round characteristics. Drag slows the bullet's velocity, increasing the time that gravity acts on the bullet, which further complicates the aiming solution. Drag is also affected by various environmental conditions, such as humidity, air pressure, altitude, and temperature. Thus, drag is not a constant that can be learned.

Wind can also affect the trajectory of the bullet. For example, the weapon typically imparts a spin to the bullet to stabilize it during flight, and this spin causes the bullet to point into a crosswind, which in turn deflects the bullet's path. Other spin-related disturbances include gyroscopic drift and the Coriolis effect.

The ARL report noted that accuracy improved with technologies that aid the warfighter in aiming the weapon to compensate for these trajectory-disturbing effects. For example, it was reported that a crosswind sensor coupled with a laser range finder (e.g., to measure range to target) increased the probability of hit to 72% and 12% at 500 m and 1000 m, respectively, and that a full, real-time ballistics calculator increased probability of hit to 89% and 23%, respectively.

A ballistic computer is typically a software application running on a small hand-held processing unit, such as a personal digital assistant (PDA). The application includes preloaded information on a variety of weapon and ammunition types, from which the operator can choose. The operator enters target range, inclination angle, and environmental information into the device, typically through a graphical user interface (GUI). The ballistic computer calculates the vertical and horizontal aim adjustments and reports them to the operator. The gunner then manually adjusts the sight on the weapon, according to the suggested aim adjustments, before engaging the target.

In addition to the ballistic computer, a sniper may also use other sensors to measure critical parameters. One such sensor is a ranging device, such as a laser range finder, which is used to measure the range (e.g., distance) to the target. An environmental sensor package to measure important parameters such as wind speed and direction, humidity, and temperature is also frequently used. These environmental sensor systems provide information to a user, which the user can enter into the ballistic computer manually. In some cases, the environmental sensing system can be integrated with the ballistic computer.

A further complicating factor in calculating effective aim compensation is target motion. A target moving at even a moderate speed relative to its size can move enough that a weapons system equipped with a ballistics calculator will still likely deliver the projectile (e.g., bullet) to the wrong location. For example, consider a person-sized target moving at a speed of 2 mph (e.g., a moderate walking speed). At a distance of 500 m, the target will move 50 cm during the flight time of a projectile fired from a M240 machine gun, which is half the target's width. Without compensation for the target's movement, hit probability is greatly reduced. While snipers are trained to visually estimate target velocity and thus provide intuitive lead prediction, such intuitive estimates have limited accuracy and often fail to compensate for target motion in multiple dimensions simultaneously (e.g., the flight path of an unmanned aerial vehicle).

Electro-optical or radar systems equipped with target trackers can aid the gunner by estimating a target's velocity relative to the line of fire. For example, the operator acquires the target using a camera or radar and indicates that the system should track the target. This allows the tracker to measure target velocity. The measured velocity can then be added to the factors considered by the ballistic computer, which can include lead prediction as part of its aim compensation calculation.

These aim compensation factors are critical for snipers operating from fixed positions. However, the aim compensation factors become secondary considerations for weapons fired from traditional mounts deployed on moving platforms, such as armored vehicles, helicopters, or boats. This is due to the fact that platform motion is rarely predictable enough for compensation by human reaction alone, which impedes the gunner from keeping the weapon aimed at a target.

A stabilized weapon mount can partially compensate for platform motion, thereby providing the needed ability to effectively engage targets at moderate to long ranges. In recent U.S. Navy performance tests, a gyroscopic-driven, two-axis, stabilized weapon mount achieved a significant improvement in aim accuracy compared to the aim accuracy achievable with a traditional weapon mount. For example, the probably of hitting a vehicle-sized target at 600 m increased from 5% to 70%.

Of course, the stability from a moving platform will not match the stability from a fixed sniper platform due to physical limitations imposed by the gimbal, which is a component of the stabilized weapon mount. These limitations include physical constraints, such as practical limits on gimbal motor response or the time lag between measuring and compensating for platform motion. However, stability does improve to the point where targeting assistance, in the form of ballistic and moving target aim compensation, can increase the probability of hitting a target.

Integrating targeting assistance or fire on incidence capability into a weapon mount has complications driven by the fast pace of battlefield engagements compared to sniper missions. While a stabilized mount can compensate for some of the motion of its platform, there is always some residual motion that affects the current aim of the weapon. The constantly changing aim angle requires real-time, low-lag computation of aim compensation. It also makes the timing of firing a critical component in placing rounds on target, since the release of the bullet must be coordinated with the current orientation of the weapon and the location and velocity of the target. Providing traditional aim feedback in terms of aim compensation in angular units is not practical, since by the time the gunner makes the manual adjustment to the weapon's aim, it is unlikely to still be correct. Since a gunner cannot react quickly enough to compensate for the changing weapon orientation and target behavior when firing from a moving platform, it is helpful to actively assist the gunner in accurately placing rounds on target.

The weapon mounts described herein advantageously provide this type of firing assistance to the gunner. The weapon mount may be a traditional manual, fixed mount or a stabilized mount. However, the firing interface is still familiar and intuitive so that it can be used effectively in the high stress environment of a battlefield.

The devices, systems, and methods described herein are directed to dual trigger weapon control systems that provide intuitive firing assistance and a familiar firing interface. The first trigger (e.g., manual trigger) is a traditional mechanical trigger that immediately fires the weapon and, for automatic weapons, continues firing as long as it is depressed. This trigger provides the familiar operation the gunner expects.

The second trigger activates firing assistance or fire on incidence functionality. The second trigger is an electronic trigger, which includes an electrical activation switch coupled to firing control logic and a trigger actuator such as a solenoid or motor. When the gunner presses the electronic trigger, it activates the firing control logic, which then sends a control signal to activate a trigger actuator that fires the weapon when desired aiming conditions are met. In some examples, the desired aiming conditions are met when the weapon's aimpoint coincides with the firing solution (e.g., aim goal) calculated by a ballistic computer. The aiming conditions can also be provided by a target tracker or other target sensor or from logic that integrates multiple sources of aim correction. In other examples, the desired aiming conditions are met when the difference between the aimpoint of the weapon and the aim goal is below a threshold.

The mounts described herein advantageously improve the gunner's ability to aim the weapon and time the release of the bullet(s) so that fired rounds hit the target. The mounts also provide the standard features of a mount: a stable platform for the weapon, a sensor that provides an enhanced view of the target, and a means of firing the weapon.

However, as mentioned above, the mounts described herein are unique in that they provide two ways to fire the weapon: a traditional mechanical trigger and an electronic trigger. The mounts further include logic, which adjusts the time between the operator's actuation of the electronic trigger and the projectile's release such that the target is within the projected hit cone of the weapon.

The components and configuration of the weapon platforms described herein allow the gunner to operate the weapon in the traditional way using the mechanical trigger, which immediate releases rounds when the trigger is depressed. Alternatively, the gunner can operate the weapon using the electronic trigger, in which case logic within the mount will time firing of the weapon to compensate for sources of error such as environmental and ballistic factors, as well as target motion, using information from the integrated sensors. This second mode of operation integrates the advantages of ballistic computer and targeting technologies into a crew-served weapon mount without interfering with the gunner's ability to manually fire the weapon at any time.

In some examples, the first trigger takes precedence over the second trigger, ensuring that the gunner can always fire the weapon. Thus, in these examples, the gunner is never prevented from firing the weapon with the manual trigger or otherwise inhibited by the firing control logic. Thus, the weapon mounts described herein provide the dual trigger capability, along with supporting sensors and control logic that provide the targeting assistance capability.

Ballistic correction computers are widely used by both civilian long range competitive gunners and military snipers. For these applications, they are stand-alone devices that provide aim correction guidance to the operator, who then adjusts the sight on their gun accordingly before taking the shot.

Some remote weapon stations (RWS) include integrated ballistic computers. In these examples, firing assistance/guidance to the operator is typically via a guidance reticle or other aim assistance symbology displayed over the scene that appears on the weapon operator's console (e.g., a display). The operator utilizes an input device to adjust the aimpoint of the weapon to coincide with the guidance reticle before firing the weapon. While the devices disclosed herein leverage the capabilities of a ballistic computer, they also provide more than just aim compensation guidance. Once the electronic trigger is depressed, the weapon is not fired until the aimpoint coincides with a good ballistic solution, reducing both the time to engage the threat and human error.

RWS also frequently employ trackers to keep the weapon aimed at a target. In a system without a ballistic computer, the operator watches the target and estimates the expected lead correction. The operator then adjusts the aimpoint to lead the target based on the estimated range and projectile flight time. More sophisticated RWS may employ both a tracker and a ballistic computer. However, in previous systems, these capabilities are not integrated with a dedicated electronic trigger and require the operator to manually adjust aim at the RWS console before firing the gun.

One previous fire control system includes a smart weapon sight that mounts to a light weight, small caliber, hand-held rifle; a ballistic computer; an integrated camera with video tracker; and a firing inhibit solenoid. When the operator activates the system, and then pulls and holds the trigger, it inhibits the weapon from firing until the aimpoint of the weapon coincides with a firing solution computed by the ballistic computer.

However, the differences between this previous fire control system and the devices described herein are significant. For example, the previous fire control system has only a single trigger, which, when the system is enabled, will not fire the weapon when depressed by the operator until the system determines that the aimpoint of the weapon coincides with the firing solution computed by the ballistic computer. The operator must disable the system before they can fire the weapon normally with the trigger.

In contrast, the weapon mounts described herein do not prevent the gunner from firing the weapon normally with the manual trigger. Rather, the weapon mounts described herein provide a second, electronic trigger that is operated separately from the traditional manual trigger. This is especially important when the calculated firing solution is not perfect (e.g., results in a miss), as the operator can quickly and immediately make any necessary adjustments and fire normally with the manual trigger. This capability makes the weapon more effective in fast-changing situations or locations with variable environmental conditions.

As mentioned above, the previous fire control system is a weapon sight that mounts to a rifle. Conversely, the weapon mounts disclosed herein have integrated targeting assistance capability. Unlike a weapon sight, the weapon mounts described herein are weapon agnostic and enable the use of longer-range target detection and tracking sensors, which cannot be effectively mounted directly to a weapon. The ability to use long range imagers or other target detection and tracking modalities, such as radar, makes the weapon systems disclosed herein more applicable to the long-range and small target applications where it is most valuable.

Moreover, although the different examples disclosed herein may be described separately, any of the features of any of the examples may be added to, omitted from, or combined with any other example.

The weapon mounts described herein are generally directed to a unique crew-served weapon mount that provides the gunner with integrated targeting assistance without impeding their ability to use the weapon in the traditional manual fashion. The baseline system includes a dual trigger weapon mount, aiming sensors, targeting sensors, and firing control logic. One trigger is fully manual and is always operational. The second trigger is electronically controlled and fires when a good aim solution is achieved. This second trigger is linked to aiming sensors, targeting sensors, and a controller comprising firing control logic, which determines when the difference between the aimpoint of the weapon and the aim goal is below a threshold. In response to this determination, a control signal is sent to trigger the weapon to fire. Several different useful variants can be made to the baseline system, which are described more fully below.

As mentioned above, the baseline system advantageously employs a dual-trigger mechanism where the manual trigger and the electronic trigger are fully compatible and do not interfere with each other. Moreover, the electronic trigger, when activated, provides targeting assistance to the gunner to improve shooting accuracy.

In some examples, the base weapon mount (e.g., platform) includes a base and a weapon cradle. The base houses the electronics and drivetrain for the weapon gimbal. The drivetrain consists of a two-axis gimbal, which controls the weapon's pan and tilt angles. Encoders are mounted with each drive to provide accurate measurements of the weapon's pan and tilt angles. In addition, a three-axis gyroscope is mounted in the base. This gyroscope measures the angular velocity in yaw, pitch, and roll induced by platform motion and any flexing in the structure caused by weapon fire. To stabilize the weapon, a processor embedded in the base computes the pan and tilt angle necessary to correct the weapon's aimpoint. The weapon cradle is highly configurable to support different weapon types. The grip options for the weapon depend on the trigger group and backplate configuration of the weapon.

One particular example of the weapon platform includes a cradle, a gimbal, and a controller. The cradle has a shape and size to receive and secure a weapon. As described above, the gimbal stabilizes the cradle by selectively controlling pan and tilt angles of the cradle. More specifically, the gimbal utilizes motors to steer and stabilize the weapon attached to the weapon platform.

Thus, in some examples, the baseline system includes a gimbaled weapon mount, which provides gyro-based stabilization in both azimuth and elevation. It is adaptable to different weapon types through the use of a weapon cradle, which allows the weapon to be inserted into the mount. The mount further includes a grip interface for the operator, which provides a mechanical trigger to fire the weapon, as well as fine aim control. The weapon mount also provides an electronic (assisted firing) trigger on the grip, as well as the sensors and firing control logic.

The grip includes mechanically-linked trigger mechanisms, which the operator depresses to fire the weapon at will. The grip also includes the electronic trigger that is coupled to a trigger actuator, which is a solenoid, in some examples. The trigger actuator is mounted and integrated into the weapon in such a way that it does not inhibit firing the weapon with the mechanical trigger. To activate firing assist, the operator depresses the electronic trigger, which activates the firing control logic embedded in the mount. When the firing conditions are met, this logic activates the trigger actuator, which in turn releases the weapon bolt, firing the weapon.

The firing control logic is housed in the mount. In the example shown in FIG. 1B, this logic resides with the gimbal stabilization controller, which is located within housing 107. The weapon mount uses the same sensors as the stabilization logic to measure the current aim direction of the gimbal, and hence the weapon. The weapon mount uses absolute encoders embedded in the stabilization motors, which measure the alignment of the mount. Since the weapon has a hard, fixed connection to the mount, these sensors also inherently measure the aimpoint of the weapon. Other alignment measurement solutions are possible, including use of relative encoders, or dual absolute (coarse) and relative (fine) encoders or even a hard mounted and bore-sighted targeting sensor. The firing control logic within the control electronics compares the measured aimpoint with the desired aimpoint, and when the difference between them is below a threshold, a control signal is sent to the trigger actuator to fire the weapon.

Figure 2:
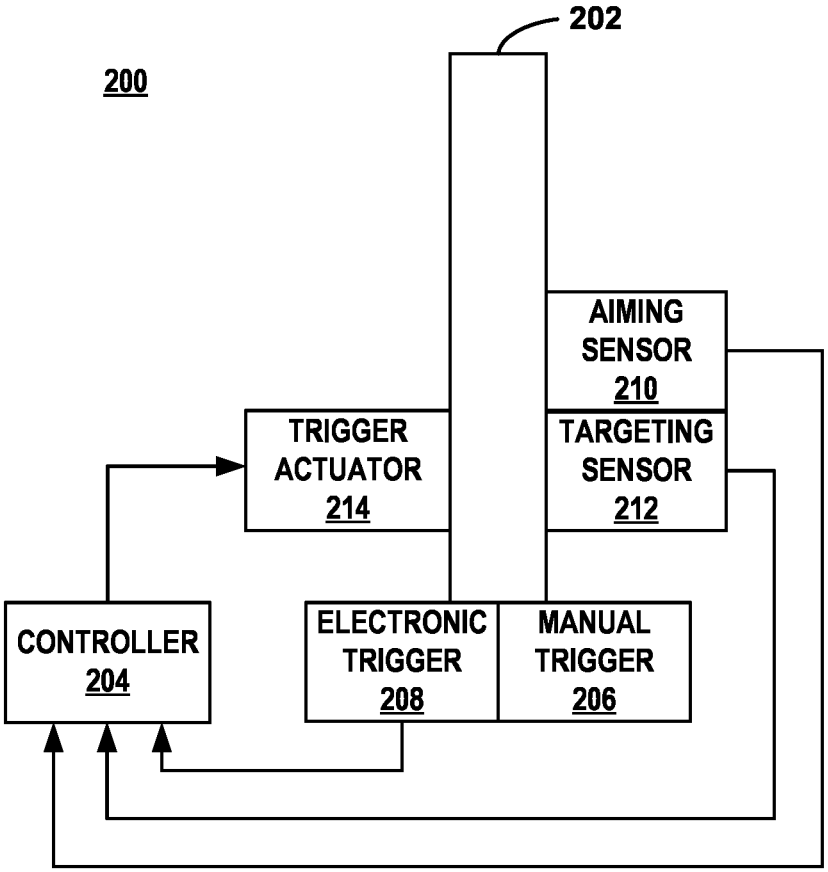
FIG. 2 is a block diagram of an example system that includes a weapon and a weapon platform having a manual trigger and an electronic trigger.

As shown in FIG. 2, system 200 includes a weapon, a manual trigger, an electronic trigger, aiming sensors for both elevation and azimuth, a targeting sensor, a controller comprising the firing control logic, and a trigger actuator. The weapon's bolt can be activated by the electronically controlled trigger actuator. The firing control logic and electronic trigger work together to generate the control signal that causes the trigger actuator to fire the weapon. The firing control logic uses information from the aiming sensors and the targeting sensor to determine when the desired aim goal has been reached, at which point it provides the control signal to activate the weapon's trigger, firing a round or burst from the weapon.

In other examples, both triggers of the dual-trigger design are electronically controlled. In these examples, the weapons would have no mechanical trigger but would have a primary electronic trigger and a secondary electronic trigger. Thus, the primary electronic trigger would enable the operator to fire the weapon immediately, at will, and the secondary electronic trigger would activate firing control logic to determine when the difference between the aimpoint of the weapon and the aim goal is below a threshold. In response to this determination, the firing control logic would send a control signal to a trigger actuator to fire the weapon.

To generate an aim goal, the mount logic includes a ballistic computation engine. This computation determines the aim goal that will place the round at the target location, by compensating for bullet drop and drift over its flight time. At a minimum, the ballistic computer needs to know the target location, as well as information on the weapon and ammunition. The weapon and ammunition are known to the operator, who provides that information to the ballistic computer. A targeting system acquires the location of the target and provides this information to the ballistic computer. A higher quality target location estimate provides a greater probability of a hit, but partial location estimates can still be effective. The target location information can be two dimensional, with assumptions about range or altitude, or three dimensional. Several targeting system options are discussed in more detail below.

More sophisticated and accurate systems may include additional sensors to provide more complete information to the ballistic computer. Other useful sensors can provide information regarding platform orientation, such as an inertial measurement unit (IMU), or environmental conditions, such as wind, temperature, pressure, and humidity. The baseline weapon systems described herein are not dependent on any particular ballistic computer or sensor suite. Any suitable ballistic computer and/or sensors may be utilized or substituted for those described herein as long as they enable the weapon mount to determine a desired aim goal with sufficient accuracy and precision to support the desired probability of a hit.

Figure 1B:
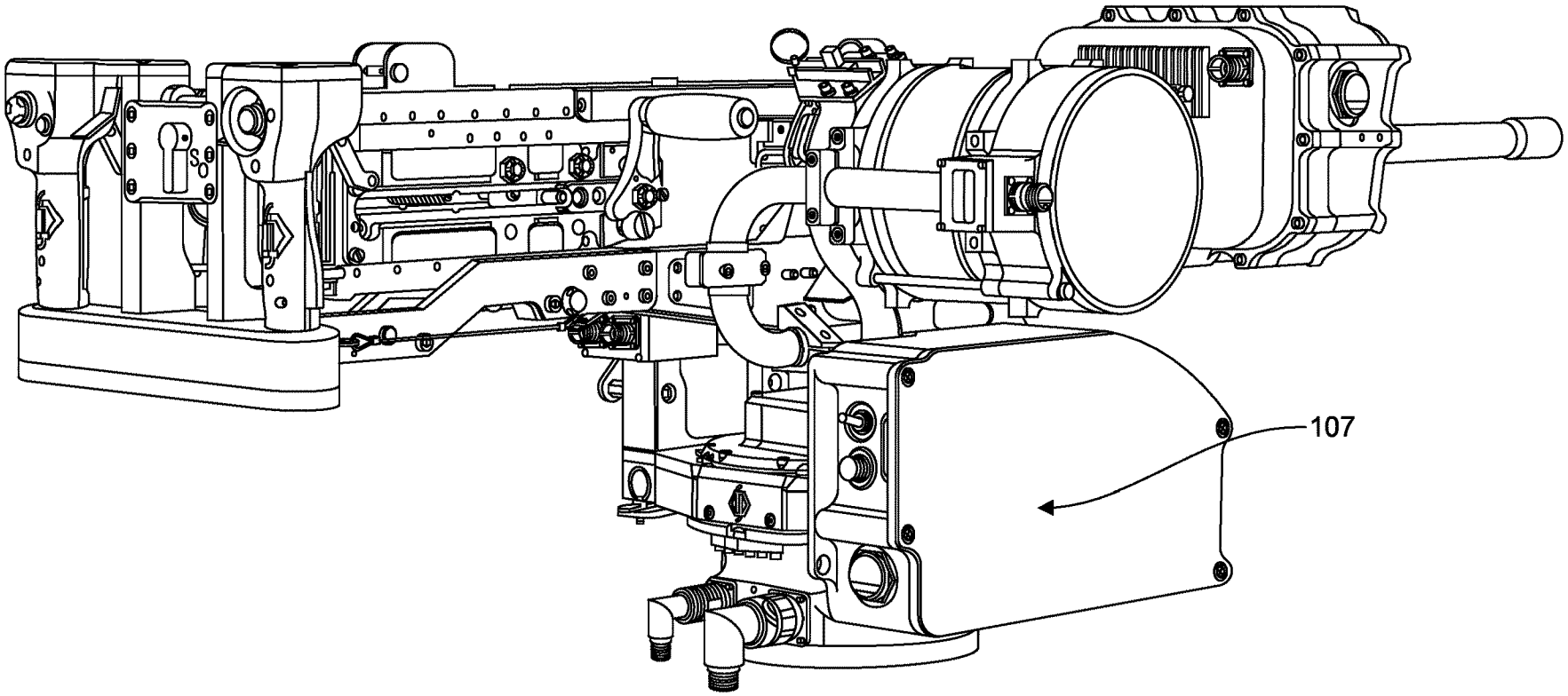
FIG. 1B is a perspective-view schematic illustration of the example weapon platform of FIG. 1A from another angle that shows a housing inside of which a controller comprising firing control logic is disposed.

FIG. 1A is a perspective-view schematic illustration of an example weapon and weapon platform having a manual trigger and an electronic trigger. FIG. 1B is a perspective-view schematic illustration of the example weapon platform of FIG. 1A from another angle that shows a housing inside of which a controller comprising firing control logic is disposed. For the example shown in FIGS. 1A and 1B, weapon platform 100 comprises cradle 104, a gimbal, manual trigger 106, at least one aiming sensor, at least one targeting sensor 108, electronic trigger 110, housing 107 containing a controller with firing control logic, and trigger actuator 112.

Cradle 104 has a shape and size to receive and secure weapon 102. In the example shown in FIG. 1A, weapon 102 is an M2 machine gun. In other examples, cradle 104 could be modified to receive any other suitable weapon.

The gimbal is integrally formed within weapon platform 100 and stabilizes cradle 104 by selectively controlling pan and tilt angles of cradle 104. More specifically, the gimbal utilizes motors to steer and stabilize weapon 102, which is attached to weapon platform 100. For example, the pan assembly is utilized to adjust the pan angle of cradle 104 (e.g., generally considered to be a pivoting movement about a vertical axis to aim weapon 102 to the right/left). A tilt motor is utilized to adjust the tilt angle of cradle 104 (e.g., generally considered to be a pivoting movement about a horizontal axis to aim weapon 102 up/down).

Weapon platform 100 further comprises manual trigger 106 to, upon actuation by an operator, fire weapon 102. As mentioned above, manual trigger 106 is available for an operator to immediately fire weapon 102 at will, regardless of whether electronic trigger 110 has been previously actuated.

As described above, a gimbal stabilization controller is located within housing 107, and weapon platform 100 uses the same sensors as the stabilization logic to measure the current aim direction of the gimbal and, hence, weapon 102. More specifically, weapon platform 100 uses absolute encoders embedded in the stabilization motors, which measure the alignment of cradle 104. Since weapon 102 has a hard, fixed connection to cradle 104, these sensors also inherently measure the aimpoint of the weapon. Thus, these sensors are considered to be aiming sensors used to obtain aimpoint information pertaining to weapon 102 mounted in cradle 104. Other alignment measurement solutions are possible, including use of relative encoders, or dual absolute (coarse) and relative (fine) encoders or even a hard mounted and boresighted targeting sensor.

Targeting sensor 108 is used to track a location of a target relative to weapon platform 100. A variety of firing goals and targeting options are possible with the baseline system. These different goals require different sensor suites, which are integrated into the mount. Targeting sensors do not interfere with the use of a traditional weapon sight mounted directly to the weapon.

In some examples, the real-time, continuous imagery provided by targeting sensor 108 is displayed to an operator via an electronic visual display that can be mounted on (e.g., physically coupled to) any suitable location on the frame (e.g., on the base or the weapon cradle) of the weapon platform, on the weapon mounted in the cradle, or on a grip of the weapon mounted in the cradle. This electronic visual display is configured to allow the operator to see a magnified image around the aim point of the weapon for identification of potential targets while simultaneously maintaining normal visual situational awareness. In this manner, the electronic visual display provides the same functionality as a typical weapon scope.

Following is a discussion of four general targeting options: a passive electro-optical targeting sensor with a target tracker, an active targeting sensor with a target tracker, a geographically located target, and a laser-designated target. In some examples, the targeting sensor may also receive a target designation input from the operator and/or automatically detect a target. Although each of the targeting options is discussed separately, it should be appreciated that two or more of these options could be combined into a single system. Also, any other suitable targeting sensor not specifically mentioned herein could be used alone or in combination any of the targeting sensor options described herein.

The first option for target detection and tracking is a passive targeting sensor and tracker system. In some examples, the passive targeting sensor is an electro-optical sensor, such as a camera. In some of these examples, the camera could be any suitable electro-optic sensor, whether it be a visible (e.g., daylight), near infrared, short-wave infrared, or thermal camera. Regardless of the type of camera used, the camera is coupled to a video tracker. This combination uses one or more cameras attached to the mount and aligned with the weapon and a display to display the camera images to the operator.

In some examples, a display screen is attached to the mount. In other examples, any other suitable display modalities may be used, including helmet mounted displays or monocles or augmented reality goggles/displays. In addition to the display, the mount provides controls to the operator to allow them to indicate (e.g., designate) a target. A target tracker, included in the control logic of the controller, maintains a lock on the designated/detected target's position relative to the weapon and estimates target speed and direction of movement. The target tracker can optionally be used to control a gimbal to keep the weapon aimed at the designated target.

In addition to tracking the target's position relative to the weapon, the system can compute a better aiming solution if it has the range to target, since the range to target determines the bullet's flight time. In some examples, an active ranging sensor, such as a laser range finder, is used to measure the range to target. In other examples, for systems mounted on a moving platform, range can be estimated using the camera using a "range from motion" algorithm. In further examples, stereo cameras can be used to estimate range. In still further examples, artificial intelligence or machine learning algorithms operating on the video stream can also be used to estimate range to the target, especially if the type of target is known. In still other examples, the system may include controls to allow the operator to enter a range determined from another source. Target location, range, direction, and speed information are fed into the ballistic computer, which uses the information to compute the azimuth and elevation angle goals for both ballistic correction and moving target lead prediction.

In some examples, the weapon mount can be outfitted with an electro-optical imager, such as a four camera (e.g., wide field of view daylight, narrow field of view daylight, wide field of view thermal, and narrow field of view thermal) package with a laser range finder, to provide targeting support. In other examples, the weapon mount may include a dual camera system. Integrating the imager into the mount provides flexibility to use different modalities and camera configurations. In addition, such a configuration enables the use of traditional weapon sights.

Housing the target tracker in the optics package minimizes communication bandwidth and latency between acquiring the imagery and computing the target location. The target location is sent to the stabilization controller in the electronics housing, where it is used to keep the weapon aimed at the target and to provide target location information to the firing control logic.

Following is a description of the operational concepts for targeting assistance using a camera and tracker system. First, the operator locates a target visually by scanning the area and steers the weapon toward the target, bringing the target into the camera's field of view. Then, the operator steers the weapon to place the target into a target tracker acquisition reticle, shown on the display. Once the target is aligned with the acquisition reticle, the operator selects (e.g., designates) the target using the provided target tracker controls. The operator may also measure or otherwise specify the range to target. The target tracker passes the relevant target information to the ballistic computer, which calculates an aim goal and provides aim guidance to the operator using symbology on the display.

The operator then actuates the electronic trigger and steers the weapon in an attempt to align the current aimpoint of the weapon toward the symbology on the display that represents the aim goal. When the weapon platform is in firing assist mode (e.g., upon actuation of the electronic trigger), the operator steers the weapon relative to the tracked target, which may also be referred to as an "offset track." Once the difference between the aimpoint of the weapon and the aim goal is below a threshold, the controller sends a control signal to the trigger actuator to fire the weapon.

If the calculated aim goal does not result in a hit when the weapon is fired, for instance if there is a crosswind along the bullet's path or the platform moves suddenly, the operator can quickly adjust the aimpoint of the weapon based on where the previous round hit and fire the weapon again using the manual trigger. Alternatively, the operator can continue to hold the electronic trigger, and the weapon will fire again when the difference between the aimpoint of the weapon and the aim goal is below the threshold. In other examples in which the calculated aim goal does not result in a hit when the weapon is fired, the weapon platform may accept feedback inputs from the operator to improve the targeting calculation. For example, the operator could use controls to input azimuth and range corrections to improve a next calculated aim goal.

The second option for target detection and tracking uses an active targeting sensor coupled with a radar tracker. In some examples, the active targeting sensor is a radar or a laser (e.g., Laser Detection and Ranging (LADAR)). This combination uses a radar or similar sensor attached to the mount, which scans the area in front of the weapon. The radar tracker links strong signals together into coherent tracks. This option also includes a display to display these tracks to the operator.

Thus, in some examples, the mount provides controls to the operator to allow them to indicate (e.g., designate) a target from among the displayed tracks. The radar tracker maintains a lock on the designated/detected target's position relative to the weapon and estimates target speed, range, and direction. The radar tracker can, in some examples, also be used to control a gimbal to keep the weapon aimed at the designated target. Target location, range, direction, and speed information are fed into the ballistic computer, which uses the information to compute the azimuth and elevation angles for both ballistic correction and lead prediction.

The operational concept for targeting assistance using a radar and tracker system is similar to that used with a camera and tracker system. For example, the operator steers the weapon to an area of interest and monitors the radar display for potential targets (e.g., an unmanned aerial vehicle (UAV) that is unauthorized to operate in a particular area). When a target is identified, the operator selects (e.g., designates) the corresponding track using the provided tracker control. The tracker passes information to the ballistic computer, which calculates an aim goal and provides aim guidance to the operator using symbology on the display. The operator actuates the electronic trigger and steers the weapon in an attempt to align the current aimpoint of the weapon toward the symbology on the display that represents the aim goal. When the weapon platform is in firing assist mode (e.g., upon actuation of the electronic trigger), the operator steers the weapon relative to the tracked target. Once the difference between the aimpoint of the weapon and the aim goal is below a threshold, the controller sends a control signal to the trigger actuator to fire the weapon.

The third option for targeting, which is useful for a variety of engagement situations, is geolocation. Targeting by geographical location is effective against fixed targets, including beyond line of sight (BLOS) engagement. It is useful for artillery mortar weapons, firing from a moving platform, or firing a mortar from a moving platform.

For this approach, the weapon mount utilizes sensors to determine its geographical location and orientation at that location. Thus, in some examples, the targeting sensor comprises one or more sensors to determine the geographical location and the orientation of the weapon platform. In more specific examples, an inertial navigation system (INS) or a combination of Global Navigation Satellite System (GNSS) receiver with an inertial measurement unit (IMU) can provide the necessary location and orientation sensing. The target is specified by its geographical location, and a tracker uses the weapon's own location and orientation to maintain aim on the target. Target location, range, and direction are provided to the ballistic computer, which computes the azimuth and elevation angles for ballistic correction.

The operational concept for targeting assistance with a geolocated target begins with specification of the target location. This location may be provided by an outside source, such as a battlefield management or C2 system, or a companion airborne system, such as a UAV. In other examples, the operator can specify a "geotracked" target by aiming the weapon at a location and selecting (e.g., designating) that location as the target. The system then uses its own location and orientation, as well as the aim angle of the weapon to determine the geographical location of the target. A terrain map may also be used in the calculation to produce a more accurate geographical location. From the geolocation, the system can extract the range, and provide both angular and range information to the ballistic computer. The operator then activates the electronic trigger and steers the weapon in an attempt to align the current aimpoint of the weapon toward the symbology on the display that represents the aim goal. When the weapon platform is in firing assist mode (e.g., upon actuation of the electronic trigger), the operator steers the weapon relative to the geotracked target. Once the difference between the aimpoint of the weapon and the aim goal is below a threshold, the controller sends a control signal to the trigger actuator to fire the weapon. This option can also be combined with other targeting options to improve the quality of the target location estimate.

As described above in connection with the third targeting option, providing a geographical location is one way to cue a weapon to a target found by another source. The fourth targeting option provides another way to "designate" the target by using a laser pointer or designator. Thus, in some examples, the targeting sensor comprises a sensor to detect a target designator, and in further examples, the target designator comprises a laser emitted from a laser pointer.

For example, the lasers used to designate a target are typically near infrared (NIR) lasers that cannot be seen with the unaided eye. Laser pointers often operate in the 820-850 nm band, where they are visible to modern cameras or night vision goggles. A near-infrared sensor is needed to make the pointer visible to the weapon operator. This is often accomplished using a grayscale complementary metal oxide semiconductor (CMOS) or charge-coupled device (CCD) camera, or with a color camera with a special cut-filter, which passes the laser energy, or with a color camera with a removable cut-filter. In some examples, a special filter may be used on a daylight camera that allows the camera to "see" (e.g., detect) lasers emitted from laser pointers that are visible to night-vision goggles (NVG). In some examples, this camera is the same camera that is used for targeting; however, it could be a separate camera, in other examples. Any other suitable designation methods/devices beyond that of a NIR laser pointer may be used to collaboratively indicate a target to the operator.

The operational concept for targeting assistance with laser designation is similar to that of the camera and tracker systems. For example, the operator scans an area of interest, looking for the laser spot to appear in the visual display of the weapon platform. Once the spot is located, the operator may steer the weapon to center the laser spot on the tracking reticle and then engage the tracking feature. Alternatively, the tracker controller can be programmed to look for a laser spot and automatically place it under track. The remainder of the operational flow is similar to that of a camera with tracker system.

Housing 107 of weapon platform 100 has a size and shape suitable to house a controller comprising firing control logic. The controller includes any combination of hardware, software, and/or firmware for executing the functions described herein as well as facilitating the overall functionality of weapon platform 100. An example of a suitable controller includes software code running on a microprocessor or processor arrangement connected to memory. As mentioned above, housing 107 may also house a gimbal stabilization controller used to stabilize the gimbal. Of course, housing 107 may be adapted, in other examples, to accommodate any of the other circuitry, logic, and components described herein.

Weapon platform 100 also includes electronic trigger 110 to, upon actuation by the operator, activate the firing control logic within the controller. As mentioned above, actuation of electronic trigger 110 does not inhibit an operator from firing weapon 102 with manual trigger 106. The controller determines an aimpoint of weapon 102, based at least partially on a signal, received from the at least one aiming sensor, containing the aimpoint information pertaining to weapon 102. The controller calculates an aim goal, based at least partially on a signal, received from targeting sensor 108, containing location information pertaining to the target. The controller then determines whether a difference between the aimpoint of weapon 102 and the aim goal is below a threshold. In response to a determination that the difference between the aimpoint of weapon 102 and the aim goal is below the threshold, the controller transmits a control signal to fire weapon 102. Based at least partially on the control signal received from the controller, trigger actuator 112 selectively fires weapon 102.

In other examples, the controller determines whether to fire the weapon, based at least partially on the aimpoint of weapon 102 and the calculated aim goal. For example, in some cases, an operator may wish to lay down suppressive fire with weapon 102 but stop firing when weapon 102 is aimed at objects/personnel that should not be fired upon (e.g., friendly forces, non-hostile civilians, etc.). Thus, in these cases, the controller would determine to cease/prevent firing weapon 102 when the aimpoint of weapon 102 is likely to cause a hit on the objects/personnel that should not be fired upon. In still further examples, the operator may wish to fire weapon 102 and cease firing based on timing rather than based on aimpoint of weapon 102. Thus, in these cases, the controller may determine to cease firing weapon 102 based on timing rather than the aimpoint of weapon 102. Regardless of the criteria utilized to determine whether to fire or cease fire, the controller transmits a control signal to initiate or cease firing weapon 102 based on the determination of whether to fire weapon 102.

FIG. 2 is a block diagram of an example system 200 that includes a weapon and a weapon platform having a manual trigger and an electronic trigger. The weapon platform comprises a cradle having a shape and size to receive and secure weapon 202. The weapon platform further comprises manual trigger 206 to, upon actuation by an operator, fire weapon 202. The weapon platform also includes at least one aiming sensor 210 to obtain aimpoint information pertaining to weapon 202, and at least one targeting sensor 212 to track a location of a target relative to the weapon platform. In some examples, the at least one targeting sensor 212 comprises at least one of the following: an electro-optical sensor, a radar, a laser, one or more sensors to determine a geographical location and an orientation of the weapon platform, and a sensor to detect a target designator.

The weapon platform additionally includes controller 204 comprising firing control logic. The weapon platform also includes electronic trigger 208 to, upon actuation by the operator, activate the firing control logic within controller 204, wherein actuation of electronic trigger 208 does not inhibit firing weapon 202 with the manual trigger 206. In operation, the controller (1) determines an aimpoint of weapon 202, based at least partially on a signal, received from the at least one aiming sensor 210, containing the aimpoint information pertaining to weapon 202, (2) calculates an aim goal, based at least partially on a signal, received from the at least one targeting sensor 212, containing location information pertaining to the target, (3) determines whether a difference between the aimpoint of weapon 202 and the aim goal is below a threshold, and (4) in response to a determination that the difference between the aimpoint of weapon 202 and the aim goal is below the threshold, transmits a control signal to fire weapon 202. The weapon platform further comprises trigger actuator 214 to selectively fire weapon 202, based at least partially on the control signal received from controller 204.

Figure 3:
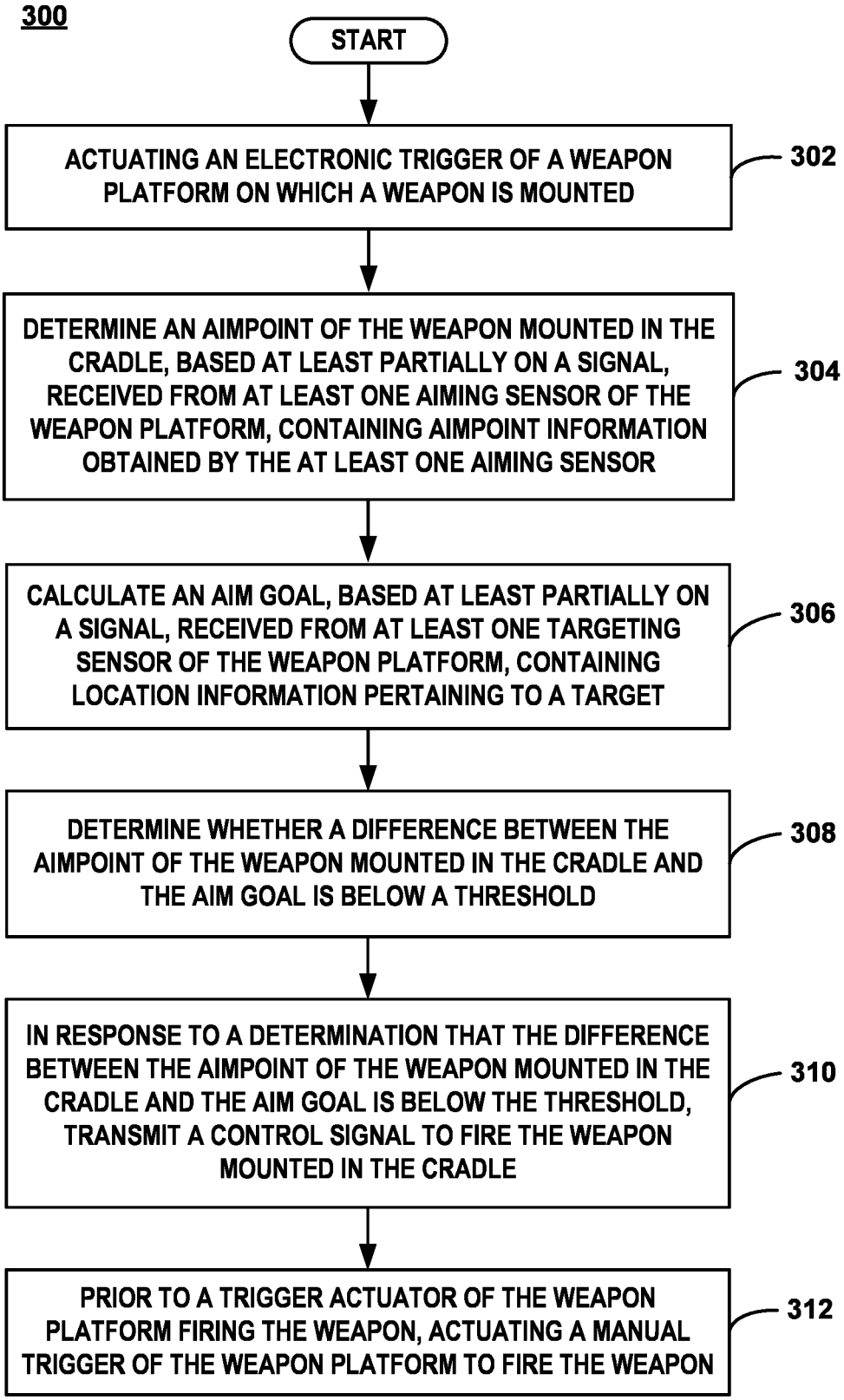
FIG. 3 is a flowchart of an example of a method in which an electronic trigger of a weapon platform is actuated; firing control logic is used to determine that a weapon mounted in a cradle of the weapon platform should be fired; a control signal is transmitted to a trigger actuator to fire the weapon; and prior to the trigger actuator firing the weapon, actuating a manual trigger of the weapon platform to fire the weapon.

FIG. 3 is a flowchart of an example of a method in which an electronic trigger of a weapon platform is actuated; firing control logic is used to determine that a weapon mounted in a cradle of the weapon platform should be fired; a control signal is transmitted to a trigger actuator to fire the weapon; and prior to the trigger actuator firing the weapon, actuating a manual trigger of the weapon platform to fire the weapon. The method 300 begins at step 302 with actuating an electronic trigger of a weapon platform on which a weapon is mounted. In some examples, the weapon platform has components and a configuration that are similar to the weapon platforms described herein. At step 304, the weapon platform determines an aimpoint of the weapon, based at least partially on a signal, received from at least one aiming sensor of the weapon platform, containing aimpoint information obtained by the at least one aiming sensor.

At step 306, the weapon platform calculates an aim goal, based at least partially on a signal, received from at least one targeting sensor of the weapon platform, containing location information pertaining to a target. At step 308, the weapon platform determines whether a difference between the aimpoint of the weapon and the aim goal is below a threshold. At step 310, in response to a determination that the difference between the aimpoint of the weapon and the aim goal is below the threshold, a control signal is transmitted to a trigger actuator of the weapon platform to fire the weapon. At step 312, prior to the trigger actuator firing the weapon, a manual trigger of the weapon platform is actuated to fire the weapon.

In other examples, one or more of the steps of method 300 may be omitted, combined, performed in parallel, or performed in a different order than that described herein or shown in FIG. 3. In still further examples, additional steps may be added to method 300 that are not explicitly described in connection with the example shown in FIG. 3. Similarly, any of the features of any of the methods described herein may be performed in parallel or performed in a different manner/order than that described or shown herein.

Clearly, other examples and modifications of the foregoing will occur readily to those of ordinary skill in the art in view of these teachings. The above description is illustrative and not restrictive. The examples described herein are only to be limited by the following claims, which include all such examples and modifications when viewed in conjunction with the above specification and accompanying drawings. The scope of the foregoing should, therefore, be determined not with reference to the above description alone, but instead should be determined with reference to the appended claims along with their full scope of equivalents.

What is claimed is:

1. A weapon control system for use with a cradle, the cradle having a shape and size to receive and secure a weapon, the system comprising:

a manual trigger to, upon actuation by an operator, fire the weapon secured in the cradle;

a controller comprising firing control logic, the firing control logic not activated upon actuation of the manual trigger;

an electronic trigger to, upon actuation by the operator, activate the firing control logic within the controller, the firing control logic, when activated:

determines an aimpoint of the weapon, calculates an aim goal, determines, based at least partially on the aim point of the weapon and the calculated aim goal, whether to fire the weapon, and in response to a determination to fire the weapon, transmits a control signal to fire the weapon secured in the cradle; and a trigger actuator to selectively fire the weapon secured in the cradle, based at least partially on the control signal from the controller.

2. The weapon control system of claim 1, further comprising the cradle.

3. The weapon control system of claim 1, wherein actuation of the electronic trigger does not inhibit firing the weapon with the manual trigger.

4. The weapon control system of claim 1, wherein the controller determines whether to fire the weapon based on whether a difference between the aim point of the weapon and the aim goal is below a threshold.

5. The weapon control system of claim 1, further comprising at least one aiming sensor to:

obtain aimpoint information pertaining to the weapon secured in the cradle, and transmit, to the controller, a signal containing the aim point information.

6. The weapon control system of claim 1, further comprising at least one targeting sensor to:

track a location of a target relative to the weapon control system, and transmit, to the controller, a signal containing location information pertaining to the target.

7. The weapon control system of claim 6, wherein the at least one targeting sensor comprises a passive targeting sensor.

8. The weapon control system of claim 7, wherein the passive targeting sensor comprises an electro-optical sensor.

9. The weapon control system of claim 6, wherein the at least one targeting sensor comprises an active targeting sensor.

10. The weapon control system of claim 9, wherein the active targeting sensor comprises a radar.

11. The weapon control system of claim 9, wherein the active targeting sensor comprises a laser.

12. The weapon control system of claim 6, wherein the at least one targeting sensor comprises one or more sensors to determine a geographical location and an orientation of the weapon control system.

13. The weapon control system of claim 6, wherein the at least one targeting sensor comprises a sensor to detect a target designator.

14. The weapon control system of claim 13, wherein the target designator comprises a laser emitted from a laser pointer.

15. The weapon control system of claim 6, wherein the at least one targeting sensor receives a target designation input from the operator.

16. The weapon control system of claim 6, wherein the at least one targeting sensor automatically detects the target.

17. A system comprising:

a weapon; and a weapon platform comprising:

a cradle having a shape and size to receive and secure the weapon, a manual trigger to, upon actuation by an operator, fire the weapon secured in the cradle, at least one aiming sensor to:

obtain aim point information pertaining to the weapon secured in the cradle, and transmit a signal containing the aim point information, at least one targeting sensor to:

track a location of a target relative to the weapon platform, and transmit a signal containing location information pertaining to the target, the at least one targeting sensor comprising at least one of the following:

an electro-optical sensor, a radar, a laser, one or more sensors to determine a geographical location and an orientation of the weapon platform, and a sensor to detect a target designator, a controller comprising firing control logic, the firing control logic not activated upon actuation of the manual trigger, an electronic trigger to, upon actuation by the operator, activate the firing control logic within the controller, wherein actuation of the electronic trigger does not inhibit firing the weapon with the manual trigger, the firing control logic, when activated:

determines an aimpoint of the weapon, based at least partially on the signal containing the aimpoint information, calculates an aim goal, based at least partially on the signal containing the location information, determines, based at least partially on the aim point of the weapon and the calculated aim goal, whether to fire the weapon, and in response to a determination to fire the weapon, transmits a control signal to fire the weapon secured in the cradle, and a trigger actuator to selectively fire the weapon secured in the cradle, based at least partially on the control signal from the controller.

18. The system of claim 17, wherein the at least one targeting sensor receives a target designation input from the operator.

19. The system of claim 17, wherein the at least one targeting sensor automatically detects the target.

20. A method comprising:

actuating an electronic trigger of a weapon platform on which a weapon is mounted, the weapon platform comprising:

a cradle having a shape and size configured to receive and secure the weapon, a manual trigger to, upon actuation by an operator, fire the weapon secured in the cradle, at least one aiming sensor to:

obtain aim point information pertaining to the weapon secured in the cradle, and transmit a signal containing the aimpoint information, at least one targeting sensor to:

track a location of a target relative to the weapon platform, and transmit a signal containing location information pertaining to the target, a controller comprising firing control logic, the firing control logic not activated upon actuation of the manual trigger, the electronic trigger to, upon actuation by the operator, activate the firing control logic within the controller, the firing control logic, when activated:

determines an aimpoint of the weapon, based at least partially on the signal containing the aimpoint information, calculates an aim goal, based at least partially on the signal containing the location information, determines, based at least partially on the aim point of the weapon and the calculated aim goal, whether to fire the weapon, and in response to a determination to fire the weapon, transmits a control signal to fire the weapon secured in the cradle, and a trigger actuator to selectively fire the weapon secured in the cradle, based at least partially on the control signal from the controller; and prior to the trigger actuator firing the weapon, actuating the manual trigger to fire the weapon secured to the weapon platform.

21. The method of claim 20, further comprising:

receiving a target designation input from the operator.

22. The method of claim 20, further comprising:

automatically detecting the target.

* * * * *